United States Patent [19]

Misicka

[11] Patent Number: 5,028,193

[45] Date of Patent: Jul. 2, 1991

[54] SADDLE-BOUND BOOKS, MAGAZINES AND THE LIKE AND PROCESS FOR MANUFACTURE SAME

[76] Inventor: James A. Misicka, 5301 E. Paradise Dr., Scottsdale, Ariz. 85254

[21] Appl. No.: 343,881

[22] Filed: Apr. 26, 1989

[51] Int. Cl.[5] ..... B42C 9/00

[52] U.S. Cl. ..... 412/8; 412/37

[58] Field of Search ..... 412/8, 33, 7, 28, 37, 412/26, 25, 18, 20; 281/21 R, 29, 15.1, 38

[56] References Cited

U.S. PATENT DOCUMENTS

| | | | |
|---|---|---|---|
| 1,646,783 | 10/1927 | Bischof . | |
| 2,119,511 | 6/1938 | Perkins | 412/33 |
| 2,124,862 | 7/1938 | Schramm | 270/53 |
| 2,168,547 | 8/1939 | Wood | 270/5 |
| 2,366,064 | 12/1944 | Sieb | 112/21 |
| 2,541,367 | 2/1951 | Kitcat | 112/21 |
| 2,607,587 | 8/1952 | Belluche | 270/53 |
| 2,873,112 | 2/1959 | Crafts et al. | 270/12 |
| 2,873,113 | 2/1959 | McWhorter | 270/12 |
| 2,895,730 | 7/1959 | Biel et al. | 270/37 |
| 3,032,336 | 5/1962 | Heigl et al. | 270/53 |
| 3,223,436 | 12/1965 | Becker | 412/8 |
| 3,560,290 | 2/1971 | Sendor et al. | 412/8 |
| 3,658,318 | 4/1972 | Bunting et al. | 270/55 |
| 3,664,655 | 5/1972 | McCain et al. | 270/56 |
| 3,730,805 | 5/1973 | Heller, Jr. et al. | 281/27 |
| 3,966,185 | 6/1976 | McCain et al. | 412/37 |
| 4,019,758 | 4/1977 | Heller, Jr. et al. | 412/8 |
| 4,083,551 | 4/1978 | St. Denis | 240/55 |
| 4,236,706 | 12/1980 | Schlough | 270/53 |
| 4,426,072 | 1/1984 | Cole et al. | 270/53 |
| 4,481,068 | 11/1984 | Richey | 156/548 |
| 4,498,663 | 2/1985 | Wamsley et al. | 270/54 |
| 4,546,961 | 10/1985 | Majewski et al. | 270/53 |
| 4,595,187 | 6/1986 | Bober | 270/37 |
| 4,641,825 | 2/1987 | Mowry et al. | 270/53 |
| 4,715,758 | 12/1987 | Stobb | 412/8 |

*Primary Examiner*—Frank T. Yost
*Assistant Examiner*—Eugenia A. Jones
*Attorney, Agent, or Firm*—Dick and Harris

[57] ABSTRACT

An automated process for binding together book or magazine signatures or the like, which signatures have been assembled together in saddle-wise fashion. An undersignature, forming the central portion of a book or magazine, is dispensed upon a moving conveyor and stabilized thereon while adhesive is deposited upon the spine of the undersignature being transported. An oversignature is dispensed upon the conveyor, stabilized thereon and then mated with the undersignature in an aligned manner such that two signatures are joined and the adhesive therebetween and distributed in a desired controlled manner. A book or magazine is thus produced whose signatures are attached with a hinge-like bond.

13 Claims, 3 Drawing Sheets

SADDLE-BOUND BOOKS, MAGAZINES AND THE LIKE AND PROCESS FOR MANUFACTURE SAME

BACKGROUND OF THE INVENTION

The present invention relates in general to bookbinding and magazine binding processes and the product produced by such processes, and in particular to an automated process for adhesively binding, in saddle-wise fashion, two or more signatures.

A common component used in the binding of books, magazines and the like is the signature. A signature, typically, is a folded and preassembled group of pages which may typically number from four (a single sheet, folded) up to 32 pages. There exist two principal methods of assembling groups of signatures together to form a magazine or book. A first kind of binding, usually reserved for books and thick magazines, is the "perfect" method of binding. In perfect binding, the components of the book, the signatures, are collected side by side and attached together with adhesive or sewing or other suitable means, with a cover thereafter placed upon the outside of the assembled signatures.

An alternative binding method, which is commonly used for pamphlets, magazines, smaller "soft bound" books and the like, is the "saddle" binding method. In this method, the components, the signatures, are each collected, arranged and affixed together in a saddle-wise fashion. The signatures used in a saddle-binding process, if consisting of two or more sheets of paper, may be internally glued together prior to assembly. The methods of gluing the sheets together may vary widely. Typically, the gluing may be accomplished by gluing webs of paper together in a continuous web feed printing press. This technique, in particular, is known as press pasting.

Typically, one signature, called an undersignature, which comprises the center-most pages of a book or magazine, is supported upon a rail or conveyor in an inverted V configuration, with the fold, called the "spine", of the undersignature oriented upwardly. A second signature, called an oversignature, is then dropped upon the undersignature. The pages on opposite sides of the spine of the innermost pages of the oversignature comprise the pages immediately before, and immediately after, the outermost pages of the undersignature upon which the oversignature is being placed. For the purposes of the present invention, in saddle-type binding, the cover of a book may as well be considered a signature.

After as many signatures as make up the book or magazine are assembled in this fashion, the signatures are then attached to one another by wire stitching. Typically, a staple is driven downward through the cover of the book and through the various underlying assembled signatures, along the respective aligned spines of the underlying signatures, and closed. A particular drawback of this form of binding process is that the binding of the respective signatures actually occurs only in the localized areas of the staple, of which usually only two or three are used. The remainder of the adjacent areas of the spines of the signatures are unbound and thus loose. In time, the staples may open, creating the possibility of injury to the reader, especially a juvenile reader, from the projecting staple ends, as well as loss of one or more of the signatures, or individual pages, of the book. In addition, as the book or magazine is used, the material of the signatures located around the staples will become worn and the holes through which the staples extend will enlarge, further encouraging tearing or loss of the signatures.

It is therefore desirable to provide a book or magazine, which may be assembled in saddle-wise fashion, utilizing the advantageous speed and easy assembly of saddlestitcher type binding processes and apparata, but without utilizing such means as staples or stitches to accomplish the binding of the signatures to one another. Accordingly, it is be desirable to provide a method by which signatures may be assembled in saddle-wise fashion and bound together by adhesive.

In U.S. Pat. No. 2,119,511 to Perkins, a process is shown for supplementing the wire attachment of saddlestitched books or magazines. In Perkins, the signatures are passed beneath a roller which applies adhesive along the spine and adjacent sides of the signature After the adhesive is applied a subsequent signature or cover is dropped onto the signature bearing the adhesive, and then the combined signatures are wire stitched. Wire stitching and an uncontrolled application of adhesive are potential drawbacks of the Perkins process. Migration of the adhesive down the adjacent sides of the signature may result in cracking or tearing of the pages of the adjoining pages as the book is opened widely and the presence of staples may render the book unsuitable for use by children due to the danger of injury.

In U.S. Pat. No. 3,966,185 to McCain, et al., a process is shown for attaching together the pages of signatures, in which a track of adhesive is applied along the length of uncut flat, unfolded sheets as they flow from a roll, which are thereafter laid together, pressed, cut and folded to form a single signature. A wire stitcher may be utilized to attach the several signatures together.

A method for attaching individual sheets together, along an edge portion of the sheets, is disclosed in U.S. Pat. No. 4,715,758 to Stobb. In Stobb, the sheets are passed beneath a wheel which has projecting from its circumference a plurality of hollow needles connected to a supply of fluid adhesive. The hollow needles pierce the collected sheets at predetermined intervals and inject the liquid adhesive which permeates the sheets and hardens to form a bond. The bond which is produced does not yield a localized bond, nor is the bond continuous along the length of the spine of the signature which is produced.

It would be advantageous to provide a process for attaching the signatures to one another, in which the adhesive is arranged along the spine of the signature in a highly localized and controlled manner, so as to form a hinge-like bond between the signatures. Such a hinge-like bond would permit the book to be opened widely without the just-described cracking of adhesive, or tearing of pages.

Accordingly, it is an object of the invention to provide a method for binding together signatures which have been assembled in saddle-wise fashion which does not employ wire stitching or needles.

Another object of the invention is to provide a process for binding together signatures which have been assembled in saddle-wise fashion which employs an adhesive to hold the signatures together, which adhesive is applied in a controlled manner along the spine of the signatures to provide a highly localized, hinge-like bond between the signatures.

Yet another object of the invention is to provide a book or magazine product which is assembled in saddle-wise fashion, and thus quickly and inexpensively, which utilizes an adhesive bead between the signatures, rather than wire stitches, to achieve a binding of the signatures, and which is therefore suitable for use especially by juvenile readers.

These and other objects of the invention will become apparent in light of the present specification, drawings and claims.

SUMMARY OF THE INVENTION

The present invention comprises an automated process for binding together two or more press pasted signatures with adhesive to produce a book or magazine or the like, with the signatures being juxtaposed in saddle-wise relation to each other. Each of the signatures includes at least one folded sheet having a spine. The two or more signatures form an undersignature and one or more oversignatures. In an automated assembly system, an undersignature is dispensed, via undersignature dispensing means, from an undersignature supply means. The undersignature is deposited upon transport means, for propulsion along a product flow direction and continuously stabilized by undersignature stabilizing means as it is propelled along the product flow direction. A bead of adhesive material is deposited in a controlled manner directly upon the spine of the undersignature, at a first one of one or more adhesive application stations.

An oversignature is then dispensed, via oversignature dispensing means, from an oversignature supply means which form an oversignature dispensing station. The oversignature is deposited upon the transport means, in substantial alignment with the undersignature, while the transport means propels the undersignature through the oversignature dispensing station. The oversignature is stabilized by oversignature stabilizing means and then the oversignature and the undersignature are mated so as to preclude undesired distribution of the bead of adhesive material between the spines of the undersignature and the oversignature. The mated undersignature and oversignature form a signature assembly, which is pressed in a first one of one or more pressing stations. The signature assembly is propelled through subsequent ones of one or more adhesive application stations, one or more oversignature dispensing stations, and one or more pressing stations, for each subsequent one of the one or more oversignatures to be added, in saddle-wise fashion, to the signature assembly.

The step of depositing the undersignature upon the transport means comprises setting the undersignature down, in spine-upward orientation, upon a chain conveyor moving along the product flow direction.

In a preferred embodiment of the invention, hot melt adhesive applicator means are used to deposit the adhesive material upon the spine of the undersignature. The bead of adhesive material comprises a substantially continuous uniform stream of adhesive material, deposited along the spine of the undersignature. Alternatively, the bead of adhesive material comprises a plurality of segments of adhesive material intermittently deposited along the spine of the undersignature.

The passage of the undersignature past a selected position along the product flow direction is sensed using sensing means. A preselected interval of time is measured, with timing means operably associated with the adhesive application means. The timing means, after having measured the preselected interval of time, sends a signal to the adhesive application means to cause the adhesive application means to deposit the adhesive material substantially exclusively while the undersignature passes the adhesive application means all without substantial over- or under-spraying.

Stabilization of the undersignature is accomplished by supporting the undersignature upon underskirt means operably associated with the transport means to prevent the undersignature from undergoing shifting, tilting or other similar undesired movement while the undersignature is propelled by the transport means along the product flow direction. Additionally, guide roller means operably arranged ahead of each of the one or more adhesive application stations are used to press the undersignature against the transport means for aligning the undersignature prior to depositing the bead of adhesive material upon the spine of the undersignature.

The step of depositing the oversignature upon the transport means comprises setting the oversignature down, in spine-upward orientation, upon the chain conveyor moving along the product flow direction. Stabilization of the oversignature is accomplished by supporting the oversignature upon overskirt means operably arranged with the transport means, along the product flow direction, extending substantially from the adhesive application station to a position ahead of the pressing means.

The signature assembly is pressed by propelling the signature assembly past roller means operably arranged with the transport means to mate and press the undersignature and the oversignature together and distribute the bead of adhesive material between the undersignature and the oversignature in a desired controlled manner. In a preferred embodiment of the invention, the last one of the one or more oversignatures is the cover.

The present invention also comprises a book, magazine, or similar article produced according to the above-described process. In particular, a book or magazine comprising at least two signatures, the signatures being juxtaposed in saddle-wise relation to each other. Each of the signatures includes at least one folded sheet having a spine. The signatures form an undersignature and one or more oversignatures. The signatures are joined together along their respective aligned spines by a bead of adhesive material. The signatures are then pressed along their respective aligned spines such that the bead of adhesive material forms a hinge-like bond between the signatures.

DETAILED DESCRIPTION OF THE DRAWINGS

Figure 1:
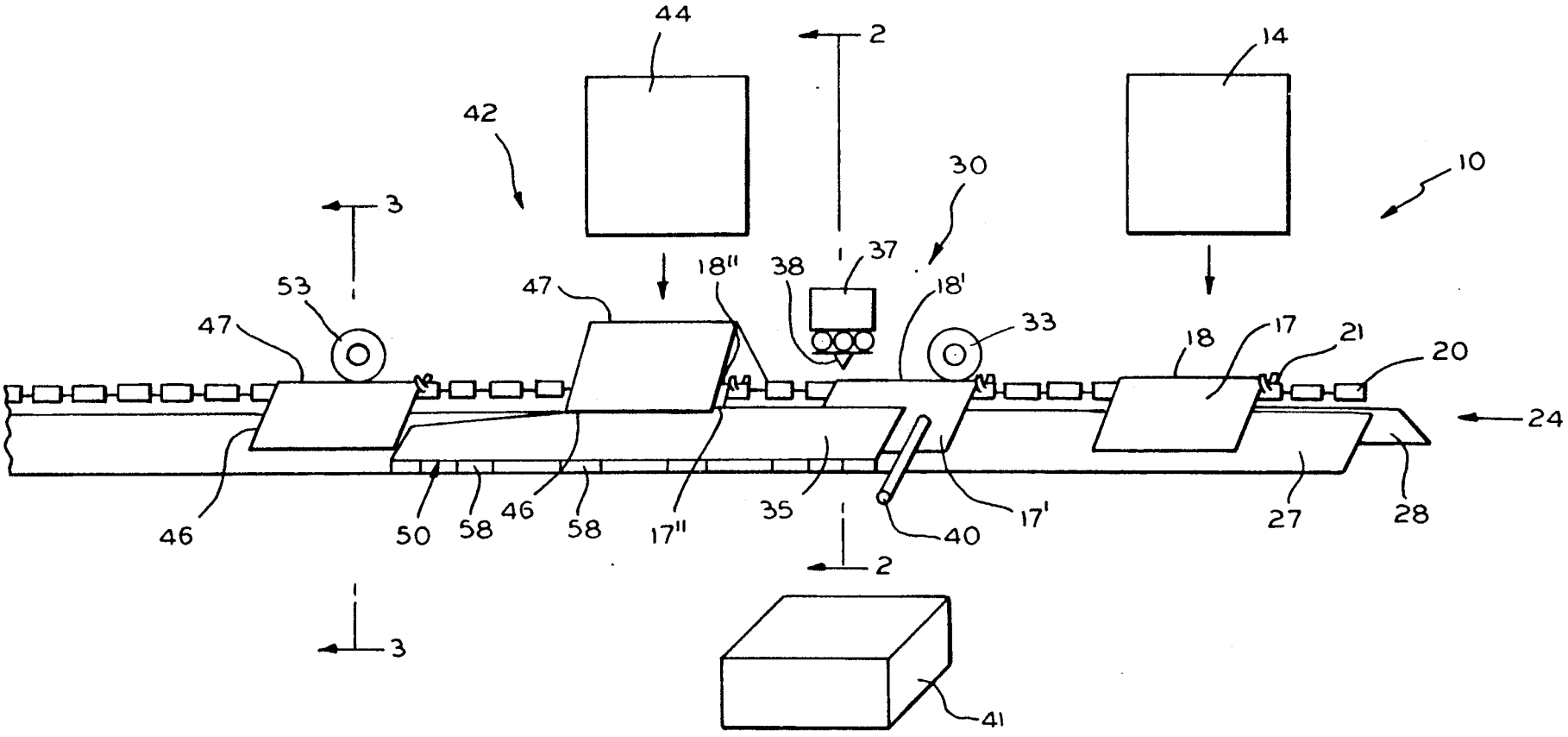
FIG. 1 is a schematic view of the process of the present invention.

While this invention is susceptible of embodiment in many different forms, there is shown in the drawings and will herein be described in detail, several specific preferred embodiments, with the understanding that the present disclosure is to be considered as an exemplification of the principles of the invention and is not intended to limit the invention to the embodiments illustrated.

The process embodied in the present invention, for binding together, with adhesive, signatures assembled in saddle-wise fashion, is shown schematically in FIG. 1. The binding apparatus for accomplishing the process of the present invention is generally indicated by reference numeral 10. An undersignature supply (included within undersignature dispenser 14) holds a number of undersignatures, each of which will form a portion of a book, magazine or the like. Each undersignature (and oversignature, as discussed below) is formed of one or more sheets, folded in half. If the undersignature is made up of multiple sheets, the sheets are typically press-pasted together prior to loading into the undersignature supply.

Binding apparatus 10 includes undersignature dispenser 14. Undersignature dispenser 14 removes an undersignature from the undersignature supply, and opens the undersignature. Undersignature dispenser 14 then deposits the undersignature, for example in FIG. 1, undersignature 17, with spine 18 oriented upwardly, onto chain conveyor 20. Chain conveyor 20 may be a continuous conveyor of the type commonly known in the art. Conveyor lugs 21 project at regular intervals from links 22 of chain conveyor 20 to insure that each undersignature 17 is propelled along the product flow direction, indicated by the arrow 24. When undersignature 17 is deposited on chain conveyor 20, the sides of undersignature 17 rest upon underskirts 27 and 28. Underskirts 27 and 28 support and stabilize undersignature 17 as it is propelled along the product flow direction.

Undersignature 17 is first propelled toward adhesive application station 30, and is designated there as undersignature 17'. Undersignature 17' passes beneath guide roller 33 which presses down and adjusts undersignature 17' closely upon chain conveyor 20 to insure that spine 18' of undersignature 17' is centered beneath adhesive applicator 37. Undersignature 17', after passing beneath guide roller 33 and while still supported and stabilized by underskirts 27 and 28, begins to pass beneath overskirt 35 (and 36, not shown in FIG. 1) and beneath adhesive applicator 37. Adhesive applicator 37 deposits a bead of semimolten adhesive material upon spine 18', in a manner to be described below. Adhesive applicator 37 as shown includes nozzle 38 and together form adhesive application station 30.

A typical applicator and nozzle combination are known and are made and sold by the Nordson Corporation as Nordson Model 2302 Hot Melt Extruder and Nordson Zero Cavity Extruder Nozzle. In the preferred embodiment of the invention adhesive applicator 37 and guide roller 33 are arranged closely together so that as undersignature 17' passes through adhesive application station 30, adhesive applicator 37 begins to deposit adhesive material upon spine 18' of undersignature 17' while the back portion of undersignature 17' is still passing beneath guide roller 33.

In order to make certain that the adhesive applicator accurately deposits adhesive with minimal under- or over-spray, application is performed in synchronization with the passage of the undersignatures therebeneath. Leading edge detector 40 is positioned slightly ahead of adhesive applicator 37. Leading edge detector 40, which may be a photoelectric eye apparatus, is connected to timer/controller 41, which is, in turn, connected to adhesive applicator 37. Timer/controller 41, such as the Nordson Timed Interval Controller, may be set so as to enable adhesive applicator 37 to eject adhesive only when an undersignature is positioned beneath the nozzle. The applicator 37 may also "fire" the adhesive either continuously, or in a predetermined pattern, as undersignature 17' passes underneath to thereby form continuous or intermittent application of adhesive.

As the undersignature 17' is propelled further along the product flow direction, it passes through oversignature dispensing station 42, and is designated there in FIG. 1 as undersignature 17''. Oversignature dispensing station 4 includes oversignature dispenser 44 which draws signatures from a signature supply, included therein, opens the signatures and drops them down onto chain conveyor 20. Preferably, oversignature dispenser 44 is timed and controlled so that it deposits oversignature 46 upon chain conveyor 20 just as undersignature 17'' passes beneath. However, oversignature 46 may be deposited on chain conveyor 20, slightly ahead of the passing undersignature 17'', so long as undersignature 17'' and oversignature 46 are aligned prior to their coming into contact. Oversignature 46 is prevented from prematurely coming into contact with undersignature 17'', and the adhesive thereon, by overskirts 35 (and 36), which are positioned above underskirts 27 and 28. Oversignature 46 thus forms the pages both immediately before and after those of undersignature 17''.

As oversignature 46 and undersignature 17'' are propelled along the product flow direction, they pass over end region 50 of overskirts 35 (and 36). The upper edges of overskirts 35 (and 36) angle downward in the direction of the product flow, bringing oversignature 46 into contact with undersignature 17'' along respective spines 47 and 18''. As combined oversignature 46 and undersignature 17'' are propelled by chain conveyor 20 off of overskirts 35 and 36, they are propelled beneath press roller 53 which presses the signatures together along their respective spines 47 and 18'' to form the bond between the signatures thereby forming a signature assembly. If the assembly of the book or magazine requires the addition of further oversignatures, then the process is repeated by extending conveyor chain 20 and adding to the production line further adhesive application stations 30, oversignature dispensing stations 42, and press rollers 53.

In the preferred embodiment of the invention, signatures having a maximum of thirty-two pages may be assembled together using the aforementioned process.

Figure 2:
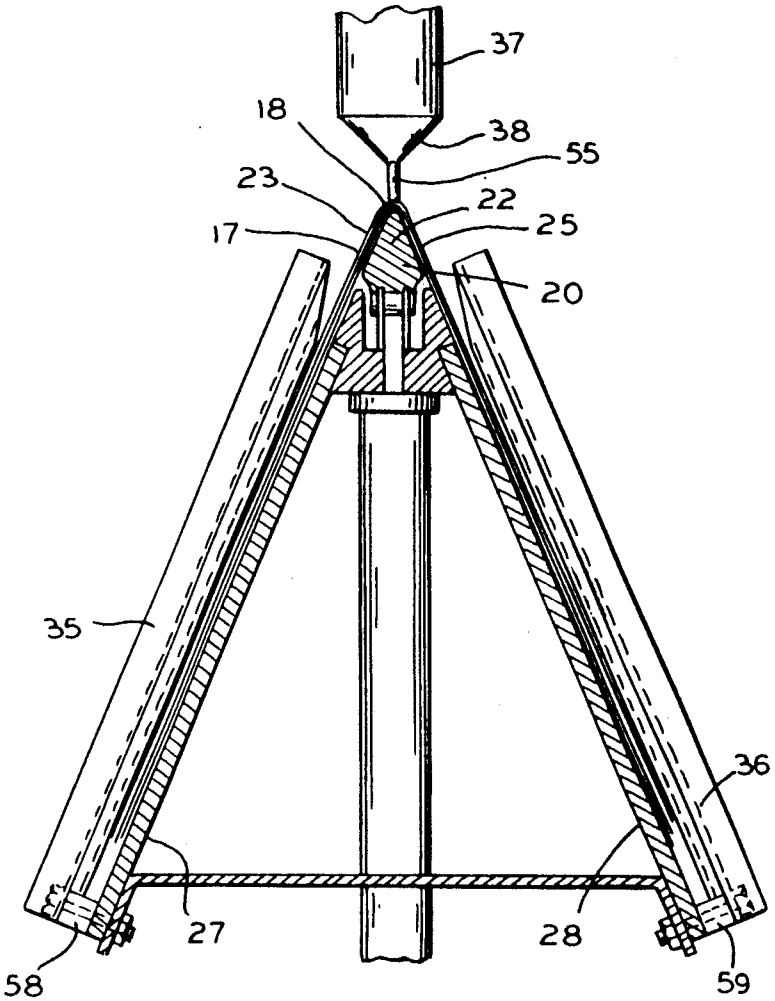
FIG. 2 is a elevation, partly in section, of the apparatus for performing the process of the present invention, taken along line 2—2.

The structure and arrangement of underskirts 27, 28 and overskirts 35, 36, according to a preferred embodiment of the invention, are seen in FIG. 2. FIG. 2 is a sectional view of the apparatus for performing the process of the present invention, taken along line 2—2 of FIG. 1. Undersignature 17' rests upon chain conveyor 20. Each link 22 of chain conveyor 20 has sides 23 and 25 which are formed at an angle which, typically, is approximately 60 degrees. In order that undersignature 17' is fully supported by underskirts 27 and 28, underskirts 27 and 28 are arranged at the same angle, of approximately 60 degrees; as sides 23 and 25 of links 22 of conveyor chain 20, and the upper surfaces of underskirts 27 and 28 are aligned with sides 23 and 25 of links 22 of chain conveyor 20, so that undersignature 17' fully rests along its lower surface while it is propelled beneath adhesive applicator 37 and bead of adhesive material 55 is deposited upon spine 18' of undersignature 17' through nozzle 38. The adhesive may be any suitable hot melt adhesive, such as National Adhesive No. 34-2912. As was shown in FIG. 1 and more clearly seen in FIG. 2, as adhesive material 55 is being deposited upon undersignature 17', undersignature 17' has already begun to pass beneath overskirts 35 and 36. Overskirts 35 and 36 are arranged substantially parallel to underskirts 27 and 28. Spacers 58 and 59 support and separate overskirts 35 and 36 from underskirts 27 and 28, respectively, and help maintain clearance between the respective overskirts and underskirts for the passage of undersignature 17'.

Figure 3:
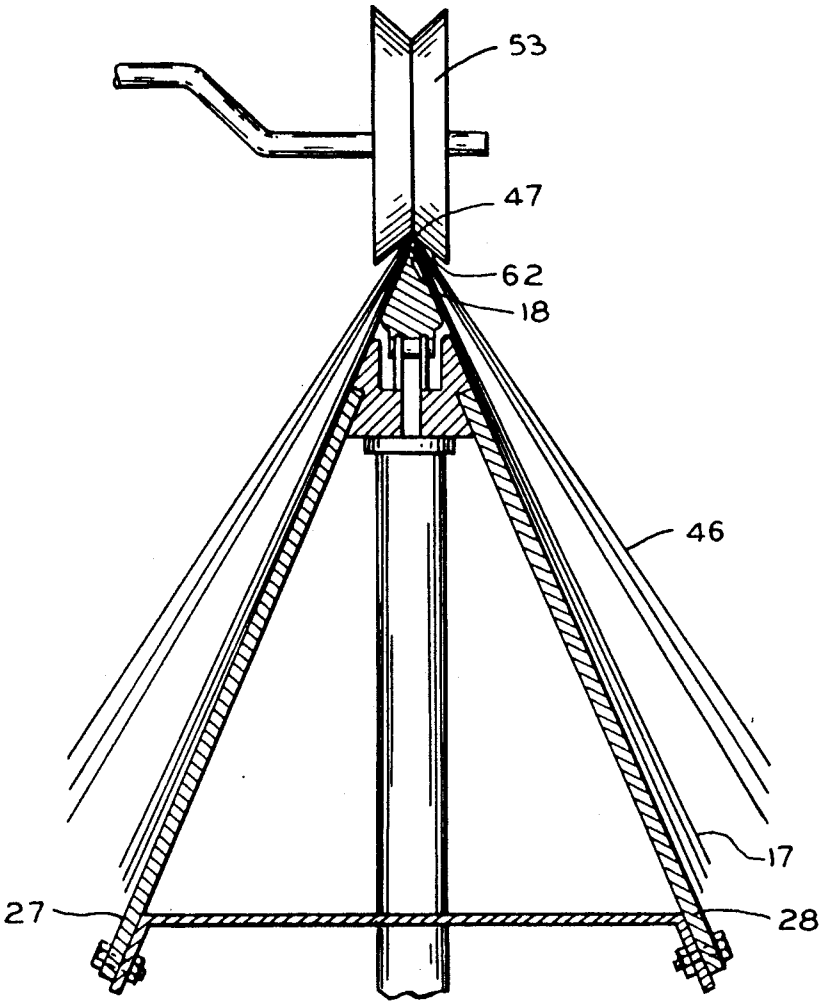
FIG. 3 is a side elevation, partly in section, of the apparatus for performing the process of the present invention, taken along line 3—3 of FIG. 1.

The pressing together of oversignature 46 and undersignature 17'' is seen in FIG. 3. As oversignature 46 and undersignature 17'' are propelled past overskirts 35 and 36, oversignature 46 is mated to and is aligned with undersignature 17'', with adhesive bead 62 extending between and along spines 18'' and 47 of undersignature 17'' and oversignature 46, respectively.

Figure 4:
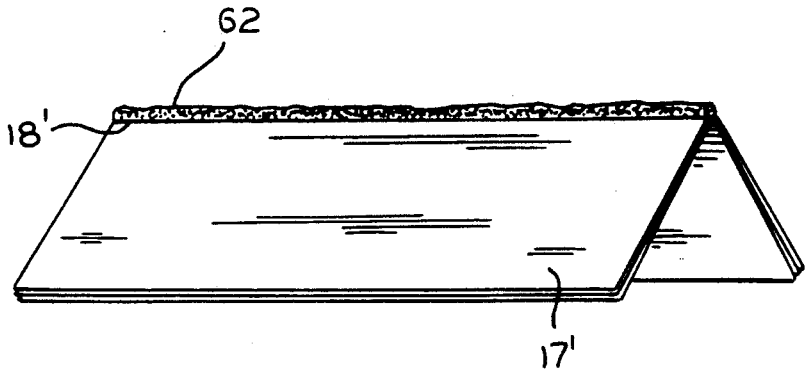
FIG. 4 is a perspective view of an undersignature showing a continuous adhesive bead, according to a preferred embodiment of the invention.
Figure 5:
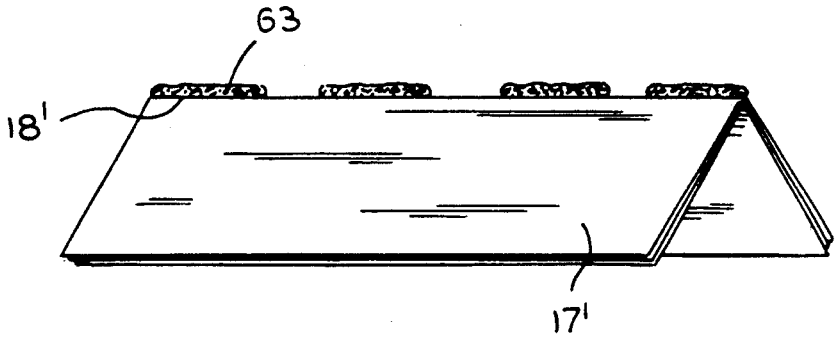
FIG. 5 is a perspective view of a signature showing an interrupted adhesive bead, according to an alternative preferred embodiment of the invention.

As was discussed in reference to FIG. 1, leading edge detector 40 and timer/controller 41, in cooperation with adhesive applicator 37, closely regulate the positioning of adhesive material 55 upon undersignatures 17'. In the preferred embodiment of the invention, adhesive material 55 is deposited upon undersignature 17' in the form of a continuous uniform bead 62, as seen in FIG. 4. If, however, it is desired to conserve the amount of adhesive material that is used in the binding process, timer/controller 41 may be adjusted so that adhesive applicator 37 deposits the adhesive material in shorter, closely spaced ribbons, so as to form an interrupted bead 63 as shown in FIG. 5.

Figure 6:
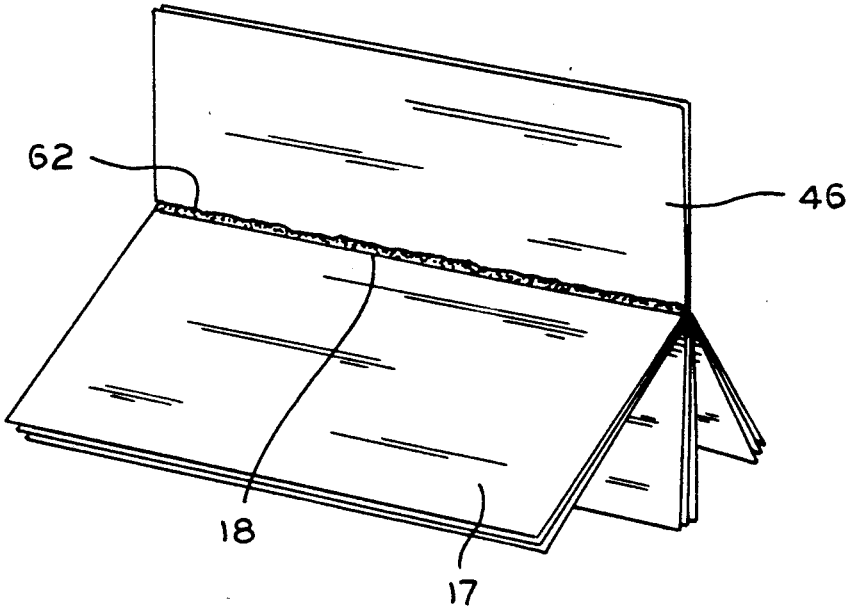
FIG. 6 shows in perspective view, a bound article produced by the process of the present invention.

A book or magazine of the kind produced by the process of the present invention is shown in FIG. 6. The narrow bead 62 which was deposited between undersignature 17 and oversignature 46, is not spread upon adjacent pages away from the spine 18 to any significant amount after pressing. Accordingly, bead 62 forms a highly localized, hinge-like bond. The bond which is produced from a continuous uniform bead is as strong as or stronger than that provided by conventional saddle-stitching with wire staples, and, having no metal staples, is safer for use, particularly among juveniles.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. A process for binding together at least two signatures with adhesive to produce an article such as a book or magazine, said signatures being juxtaposed in saddle-wise relation to each other, each of said signatures including at least one folded sheet having a spine, said at least two signatures forming an undersignature and one or more oversignatures, said method for binding together at least two signatures comprising the steps of:

dispensing an undersignature, via undersignature dispensing means, from an undersignature supply means;

depositing said undersignature upon transport means, for propulsion of said undersignature along a product flow direction;

stabilizing said undersignature with undersignature stabilizing means while said undersignature is propelled along said product flow direction;

depositing a bead of adhesive material on said spine of said undersignature, at a first one of one or more adhesive application stations;

in a first one of one or more oversignature dispensing stations, dispensing an oversignature via oversignature dispensing means from an oversignature supply means;

depositing said oversignature upon said transport means, in substantial alignment with said undersignature, while said transport means propels said undersignature through said oversignature dispensing station, stabilizing said oversignature with oversignature stabilizing means;

mating said oversignature and said undersignature so as to preclude undesired distribution of said bead of adhesive material between said spines of said undersignature and said oversignature, respectively, said mated undersignature and oversignature forming a signature assembly;

pressing said signature assembly in a first one of one or more pressing stations; and propelling said signature assembly through subsequent ones of said one or more adhesive application stations, one or more oversignature dispensing stations, and one or more pressing stations, for each subsequent one of said one or more oversignatures to be added, in saddle-wise fashion, to said signature assembly.

2. The process according to claim 1 wherein said step of depositing said undersignature upon transport means comprises setting said undersignature down, in spine-upward orientation, upon a chain conveyor moving along said product flow direction.

3. The process according to claim 2 wherein said step of stabilizing said oversignature with oversignature guide means comprises supporting said oversignature upon overskirt means operably arranged with said transport means, along said product flow direction, extending substantially from said adhesive application station to a position ahead of said pressing means.

4. The process according to claim 1 wherein said step of depositing said bead of adhesive material on said spine of said undersignature comprises using hot melt adhesive applicator means to deposit said adhesive material upon said spine of said undersignature.

5. The process according to claim 4 wherein said step of depositing said bead of adhesive material on said spine of said undersignature further comprises the step of depositing a substantially continuous stream of adhesive material along said spine of said undersignature.

6. The process according to claim 4 wherein said step of depositing said bead of adhesive material on said spine of said undersignature further comprises the step of depositing a plurality of segments of adhesive material intermittently along said spine of said undersignature.

7. The process according to claim 1 further comprising the steps of:

sensing the passage of said undersignature past a selected position along said product flow direction using sensing means; and measuring a preselected interval of time, with timing means operably associated with said adhesive application means, said timing means, after having measured said preselected interval of time, sending a signal to said adhesive application means enabling said adhesive application means to deposit said adhesive material substantially exclusively while said undersignature passes said adhesive application means.

8. The process according to claim 1 wherein said step of stabilizing said undersignature with undersignature guide means further comprises supporting said undersignature upon underskirt means operably associated with said transport means to prevent said undersignature from undergoing shifting, tilting or other similar undesired movement while said undersignature is propelled by said transport means along said product flow direction.

9. The process according to claim 8 wherein said step of stabilizing said undersignature with undersignature guide means further comprises using guide roller means operably arranged ahead of each of said one or more adhesive application stations to press said undersignature against said transport means for aligning said undersignature prior to said step of depositing said bead of adhesive material upon said spine of said undersignature.

10. The process according to claim 1 wherein said step of depositing said oversignature upon said transport means comprises setting said oversignature down, in spine-upward orientation, upon said chain conveyor moving along said product flow direction.

11. The process according to claim 1 wherein said step of pressing said signature assembly in a first one of one or more pressing stations further comprises the step of propelling said signature assembly past roller means operably arranged with said transport means for pressing said undersignature and said oversignature together and distributing said bead of adhesive material between said undersignature and said oversignature in a desired controlled manner.

12. The process according to claim 1 wherein the last one of said one or more oversignatures comprises a cover for an article such as a book or magazine.

13. A process for binding together at least two signatures with adhesive to produce an article such as a book or magazine, said signatures being juxtaposed in saddle-wise relation to each other, each of said signatures including at least one folded sheet having a spine, said at least bound two signatures forming an undersignature and one or more oversignatures, said method for binding together at least two signatures comprising the steps of:

dispensing an undersignature, via undersignature dispensing means, from an undersignature supply means;

depositing said undersignature upon transport means, in spine-upward orientation, for propulsion of said undersignature along a product flow direction;

stabilizing said undersignature during said propulsion of said undersignature along said product flow direction, by undersignature assembly guide means operably arranged substantially continuously adjacent to said transport means, along said product flow direction;

propelling said undersignature through a first one of one or more adhesive application stations;

depositing a bead of adhesive material on said spine of said undersignature;

propelling said undersignature through a first one of one or more oversignature feeding stations, each of said one or more oversignature feeding stations being operably associated with a corresponding one of said one or more adhesive application stations, each of said oversignature feeding stations further having an oversignature supply means and oversignature dispensing means operably associated therewith and oversignature guide means operably arranged adjacent to said transport means, along said product flow direction;

dispensing an oversignature from said oversignature supply means with said oversignature dispensing means;

depositing said oversignature upon said oversignature guide means, in spine-upward orientation, while said transport means propels said signature having said bead of adhesive material deposited upon said spine thereof through said oversignature dispensing station;

said oversignature guide means and said transport means being operably associated to maintain said oversignature above and in substantially aligned and spaced relationship to said undersignature, in substantially saddle-wise relation thereto, while simultaneously propelling said undersignature and said oversignature along said product flow direction, said oversignature guide means operably configured so as to guide and stabilize said oversignature along said product flow direction toward bringing said oversignature and said undersignature smoothly and evenly into said juxtaposed saddle-wise relation to each other while maintaining said bead of adhesive material uniformly positioned between said spines of said undersignature and said oversignature;

propelling said oversignature off of said oversignature guide means onto said undersignature so as to bring said undersignature and said oversignature into said juxtaposed saddle-wise relation to each other to form a signature assembly; and propelling said signature assembly through a first one of one or more pressing stations having rolling means operably arranged adjacent said transport means for pressing together said signature assembly along said spines to cause said bead of adhesive material between said spines to form a hinge-like bond between said signatures to form a bound signature assembly, propelling said bound signature assembly through subsequent ones of said one or more adhesive application stations, one or more oversignature dispensing stations, and one or more pressing stations, for each subsequent one of said one or more oversignatures to be added, in saddle-wise fashion, to said juxtaposed signatures.

* * * * *